US007053839B2

(12) United States Patent
Cassel et al.

(10) Patent No.: US 7,053,839 B2
(45) Date of Patent: May 30, 2006

(54) ANTENNA FOR A PORTABLE COMMUNICATION APPARATUS, AND A PORTABLE COMMUNICATION APPARATUS COMPRISING SUCH AN ANTENNA

(75) Inventors: Erland Cassel, Djursholm (SE); Jan Cassel, Djursholm (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 473 days.

(21) Appl. No.: 09/887,144

(22) Filed: Jun. 22, 2001

(65) Prior Publication Data

US 2002/0039081 A1 Apr. 4, 2002

(30) Foreign Application Priority Data

Jun. 22, 2000 (SE) ..... 0002375

(51) Int. Cl.
*H01Q 1/24* (2006.01)
*H01Q 1/36* (2006.01)

(52) U.S. Cl. ..... 343/702; 343/895

(58) Field of Classification Search ..... 343/895, 343/702; H01Q 1/24, 1/36
See application file for complete search history.

(56) References Cited

U.S. PATENT DOCUMENTS 6,275,198 B1 8/2001 Kenoun et al.

FOREIGN PATENT DOCUMENTS

| | | | |
|---|---|---|---|
| EP | 0814536 | A2 | 12/1997 |
| EP | 0 938 158 | A2 | 8/1999 |
| EP | 0 987 788 | A2 | 3/2000 |
| JP | 10-51224 | A | 2/1998 |
| JP | 10-229304 | A | 8/1998 |
| WO | 0003451 | A1 | 1/2001 |

*Primary Examiner*—Michael C. Wimer
(74) *Attorney, Agent, or Firm*—Potomac Patent Group PLLC

(57) ABSTRACT

An antenna for a portable communication apparatus has a radiator with first and second ends, the first end being connected to radio circuitry in the portable communication apparatus. The antenna also has a feedback conductor having a first end that is connected to the second end of the radiator. The feedback conductor extends along the radiator in a first direction from the second end of the radiator towards the first end of the radiator. A second end of the feedback conductor extends along the radiator in a second direction from the first end of the radiator towards the second end of the radiator, for tuning the frequency of the antenna.

8 Claims, 12 Drawing Sheets

ANTENNA FOR A PORTABLE COMMUNICATION APPARATUS, AND A PORTABLE COMMUNICATION APPARATUS COMPRISING SUCH AN ANTENNA

BACKGROUND

Generally speaking, the present invention relates to antennas for portable communication apparatuses, such as mobile telephones. More specifically, the invention relates to an antenna of the type comprising a radiator having a first end for connection to radio circuitry in the portable communication apparatus, and a second end.

A portable communication apparatus, such as a mobile telephone, a cordless telephone, a portable digital assistant, a communicator or a paging device, requires some form of antenna in order to establish and maintain a wireless radiolink to another unit in a telecommunication system. A widely used antenna in this field is a stub or helix antenna, comprising a helically wound thin metal wire or ribbon, which is embedded in a protective molding of dielectric material, or is alternatively covered by a dielectric radome. FIG. 24 illustrates a schematic mobile telephone 1 having such a stub or helix antenna 2 mounted on the exterior of a top surface of the apparatus housing of the mobile telephone.

FIG. 1 provides a schematic illustration of a miniaturized end-fed halfwave helix antenna according to the prior art. The antenna comprises a helical radiator 10 having a first end 11, to which an impedance matching circuit 13 is connected. The purpose of the impedance matching circuit 13 is to match the high input impedance (for instance about 200 ohm) of the end-fed halfwave helical radiator 10 to the lower impedance (normally 50 ohm) of a coaxial connector or coaxial cable, which in turn is coupled to radio circuitry within the portable communication apparatus. The helical radiator 10 has a free second end 12. When fed with an electric signal at appropriate frequency(-ies) from the radio circuitry of the portable communication apparatus through the impedance matching circuit 13, the helical radiator 10 acts as a halfwave dipole antenna, as is schematically illustrated by a current arrow I in FIG. 1.

SUMMARY

It is an object of the present invention to provide an antenna with considerable flexibility in terms of bandwidth. More specifically, an object of the present invention is to provide an antenna, which in different embodiments may operate as a single-band antenna, a multi-band antenna and a super broadband antenna.

Another object of the present invention is to provide an improved antenna gain in relation to previously known antennas.

Yet another object of the invention is to eliminate the need for a separate impedance matching circuit.

The above objects have been achieved through an antenna according to the enclosed independent patent claim. More specifically, the objects have been achieved by the provision of a feedback conductor having a first end, which is connected to the second or "free" end of the radiator. The feedback conductor is arranged along the radiator in a direction from the second end of the radiator towards the first end or "feeding" end of the radiator. According to different embodiments, by varying the design of the feedback conductor, the width and location of the frequency range, the input impedance, and current distribution may all be tuned as desired.

Other objects, features and advantages of the present invention will appear from the following detailed disclosure of embodiments, from the attached drawings as well as from the subclaims.

BRIEF DESCRIPTION OF THE DRAWINGS

Preferred and alternative embodiments of the present invention will now be described in more detail, reference being made to the accompanying drawings, in which.

Data in the diagrams shown in FIGS. 8–19 relate to the input point of the antenna, whereas data in the diagrams shown in FIGS. 20–23 relate to the input point of the measurement equipment.

DETAILED DESCRIPTION

This section will describe a novel feedback antenna, which in different embodiments may be used for a single frequency band, multiple frequency bands or for super broadband applications (covering up to 2 octaves). In its different embodiments, the antenna according to the invention may be realized as an end-fed miniaturized quarter-wave-resonant radiator or as a halfwave-resonant radiator having its center frequency in a desired lowest frequency band.

Figure 1:
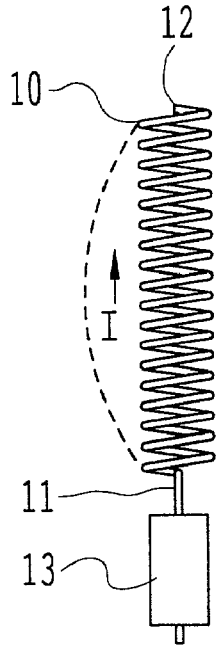
FIG. 1 is a schematic illustration of a helix antenna according to the prior art.

First, reference is again made to FIG. 1, which illustrates a known antenna design for a miniaturized end-fed halfwave antenna, where a thin metal wire or ribbon is wound in a helical shape so as to form a helical radiator or helix 10. As previously mentioned, the impedance matching circuit 13 is required in order to match the higher input impedance of the end-fed halfwave dipole radiator 10 to the lower impedance of a coaxial contact or a coaxial cable, which connects the radiator 10 to radio circuitry in the portable communication apparatus.

Figure 2:
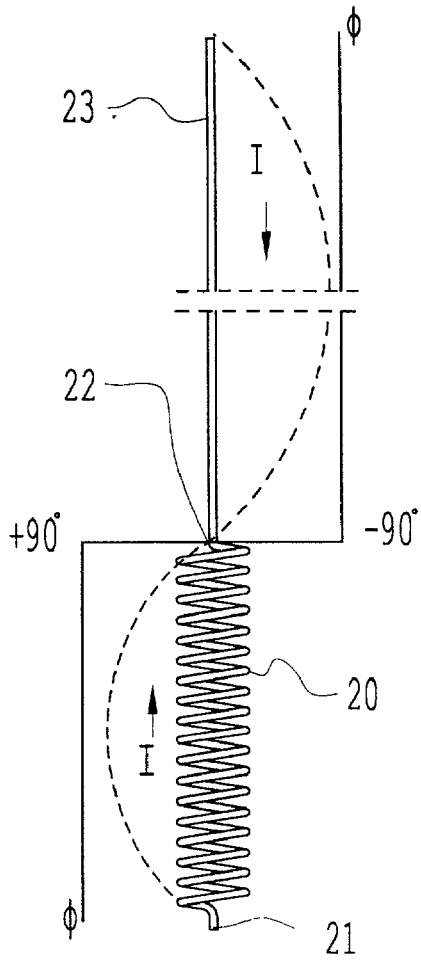
FIG. 2 is a schematic illustration, which will assist in explaining the basic principle of the invention.
Figure 3:
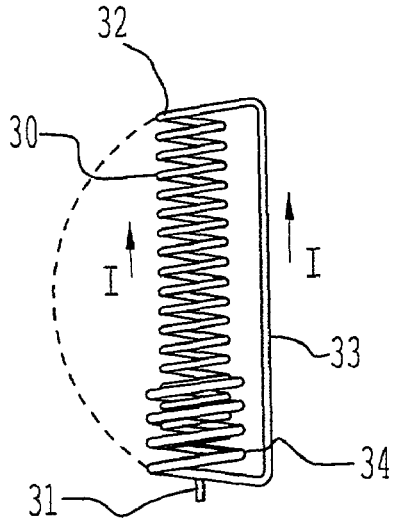
FIG. 3 illustrates a first embodiment of the invention.

Referring now to FIG. 2, there is illustrated a theoretical antenna design, where a thin metal wire or ribbon is formed, in a first portion, as a helical radiator 20 having a first feeding end 21 and a second end 22. In contrast to the known antenna of FIG. 1, the helical radiator 20 continues, at its end 22, with a linear piece 23 of the thin metal wire or ribbon. The length of the linear portion 23 equals one halfwave, as is schematically illustrated in FIG. 2. As is generally known per se, the conduction current equals 0 at the ends of a metallic halfwave radiator. In a situation like in FIG. 2, where the current is allowed to continue along the metal wire or ribbon of the radiator after the zero crossing (at position 22 in FIG. 2), the phase of the current will change 180° at the zero point of the current amplitude. In other words, the current changes direction completely in the upper halfwave as compared to the lower halfwave. Furthermore, if also the spatial direction of the current is changed 180° by bending the linear piece 23, so that it extends downwardly as in FIG. 3, this downwardly bent portion 33 (FIG. 3) of the thin metal wire or strip will exhibit the same current direction as the helical radiator 30. In other words the current paths in the helical radiator 30 and the linear portion 33 will have the same direction, as indicated in FIG. 3. Admittedly, according the Lenz' law, counter-currents will be generated between these current paths due to the coupling between them; however, thanks to the miniaturization of one of the half-wave radiators and the substantially different design between the two halfwave radiators, the current segments of the two radiators will essentially be orthogonal in relation to each other, wherein aforesaid coupling will be relatively low.

Since the free end of a radiator is of great importance for the phase and amplitude distribution of the radiator current, one may not simply cut off the part of the linear halfwave radiator 23/33, which a priori will extend below the helical radiator 20/30 past the feeding end 21/31. However, the current distribution of the remaining portion of the linear halfwave radiator 23/33 may substantially be maintained, if the lower portion of the linear radiator 33 is formed as an inductive load in the form of an endcoil 34, as shown in FIG. 3. The end coil 34 will load the free end of the linear radiator 33 to an extent, so that the loaded radiator 33 will maintain its halfwave resonance. The loading is increased further by arranging the endcoil 34 around the outside of the lower portion of the helical radiator 30 in a vicinity of the feeding end 31 of the latter.

To summarize the teachings this far, by providing a helical radiator 20/30 with a linear feedback conductor 23/33, which is connected to the second end 22/32 of the helical radiator 20/30 and which extends downwardly along the helical radiator 20/30 and ends at a position near the first end 21/31 of the helical radiator 20/30, it is possible to control both the resonant frequencies of the antenna and its input impedance. Available factors for tuning these parameters are the detailed design of the helical radiator 30, the detailed design of the linear feedback conductor 33, the detailed design of the endcoil 34 and the exact position of the endcoil 34 with respect to the helical radiator 30. If the endcoil 34 of the feedback conductor 33 is placed at the bottom of the helical radiator 30, as shown in FIG. 3, resonance may be obtained at a plurality of frequency bands, which are relatively close to each other. For instance, the center frequency of the lowest frequency band may be at 900 MHz, followed by a next frequency at either 1500 MHz or 1750 MHz.

If the endcoil 34 is instead moved closer to the center of the helical radiator 30, the resonant frequency band of the antenna is compressed and is also shifted to lower frequencies, i.e. the resonant range of the lower frequency band is shifted slightly in frequency, whereas higher frequency bands are shifted slightly more in frequency.

Thus, if the antenna is dimensioned correctly, so that a base frequency band (preferably the lowest frequency band) is correctly located, it is possible to adjust the location of other frequency bands, in which it is desired to use the antenna.

In the design illustrated in FIG. 3 the antenna is provided with its end coil load 34 at the lower end of the feedback conductor 33. One reason for this is to provide feedback to the helical radiator 30. Another reason is to shorten the mechanical length of the antenna. Now, it is readily realized that when the feedback conductor 33, including the endcoil 34, has an electrical length, which corresponds to one half of a wavelength at a certain frequency, a zero current will be obtained at the uppermost portion 32 of the antenna, i.e. where the feedback conductor 33 is connected to the helical radiator 30, even if the helical radiator 30 has another electrical length than one half of a wavelength, for instance a quarterwave length. Consequently, the halfwave-like current distribution, which is indicated along the helical radiator 30 in FIG. 3, is only one example of a possible current distribution along the helical radiator 30. By providing the endcoil 34 around the helical radiator 30 as in FIG. 3, a feedback is obtained by means of which the input impedance (i.e. current and voltage conditions) of the antenna may be controlled. Thus, if the helical radiator is provided with an electrical length, which corresponds to one half of the wavelength, it is possible, thanks to the feedback in combination with a correct dimensioning of the helical radiator 30, to reduce the input voltage and increase the input current of the end-fed halfwave dipole, thereby obtaining an antenna input impedance, which is matched to a 50 ohm system. Therefore, the impedance matching unit 13 of the previously known antenna shown in FIG. 1 may be avoided, thereby obviously providing a save in cost.

Moreover, thanks to the reduced input voltage of the antenna, the feedback principle according to the present invention will also reduce the coupling to the apparatus housing or chassis of the portable communication apparatus. As a consequence, an improved antenna gain is available.

Figure 8:
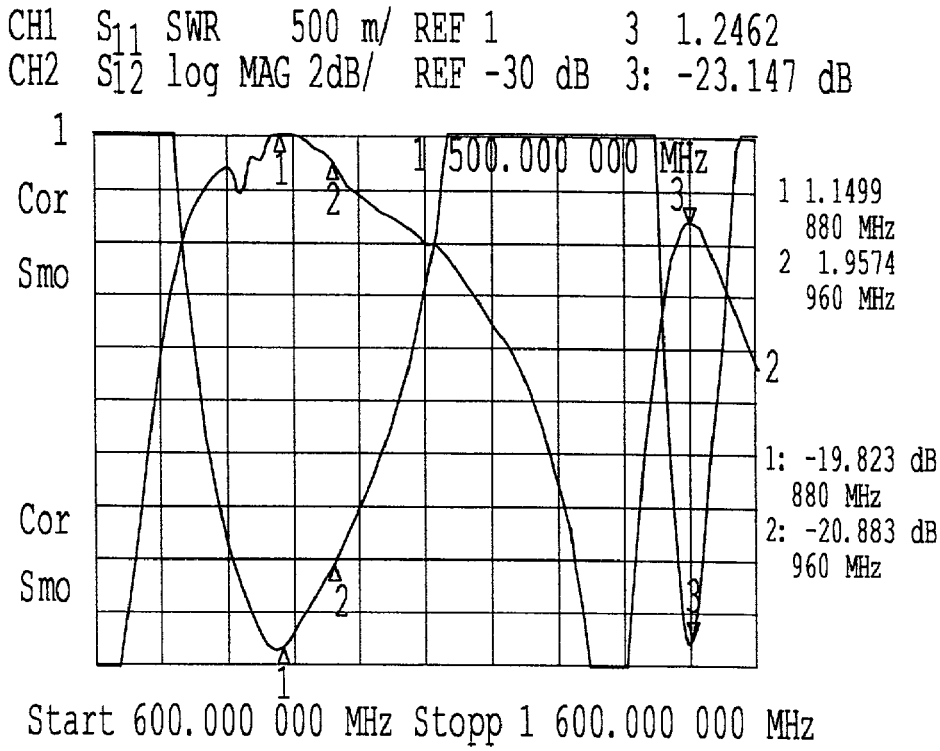
FIG. 8 is a standing wave ratio (SWR) diagram for the first embodiment shown in FIG. 3.
Figure 9:
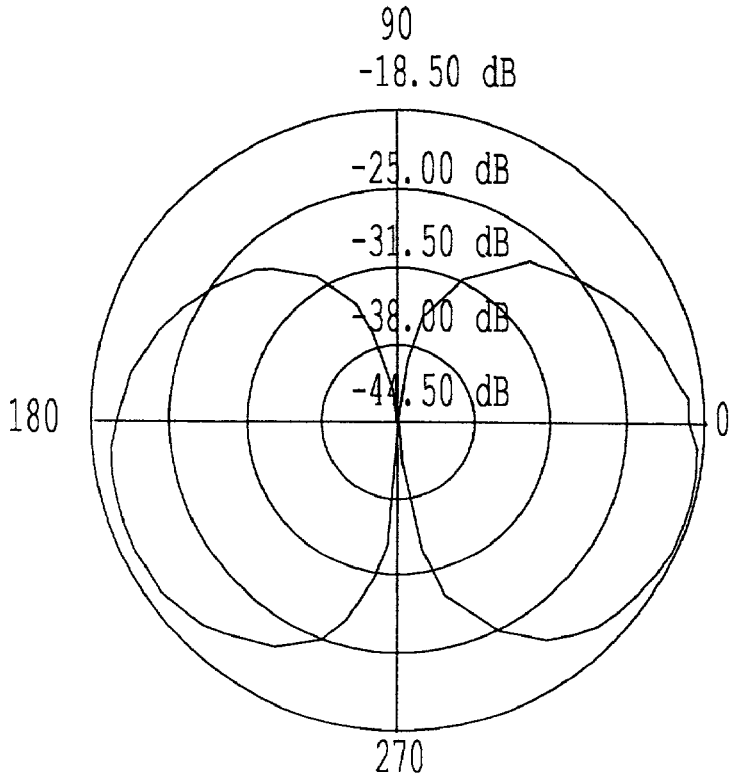
FIG. 9 is a diagram of the E plane of the antenna in FIG. 3 at 880 MHz.
Figure 10:
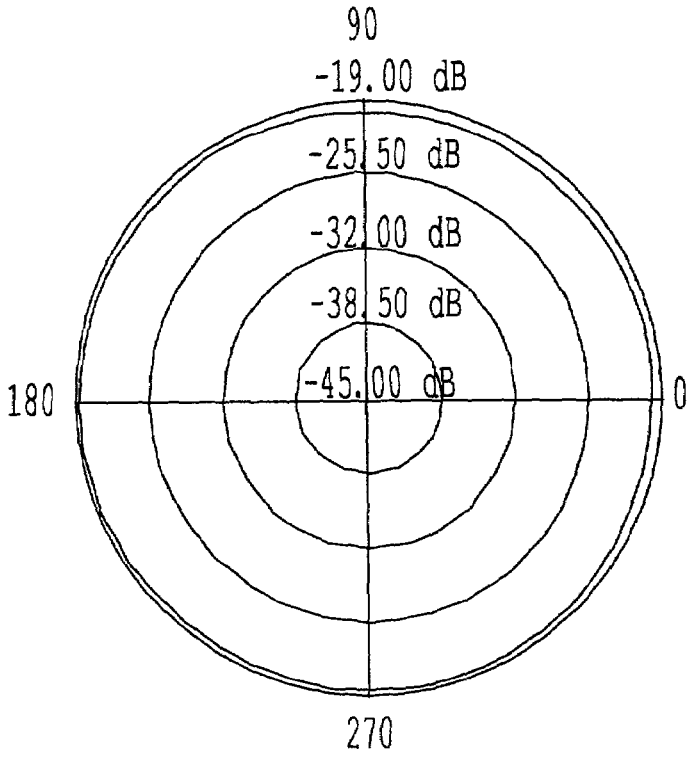
FIG. 10 is a diagram of the H plane of the antenna in FIG. 3 at 880 MHz.
Figure 11:
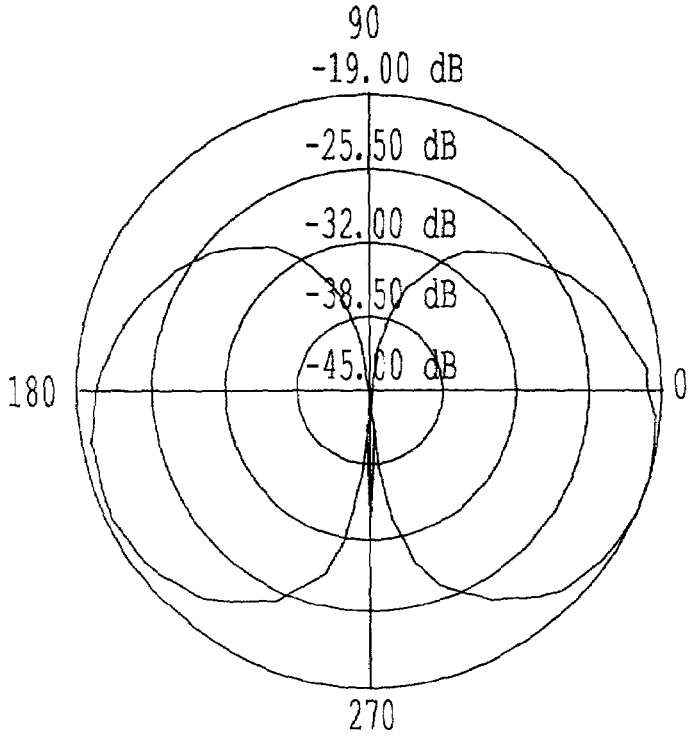
FIG. 11 is a diagram of the E plane of the antenna in FIG. 3 at 960 MHz.
Figure 12:
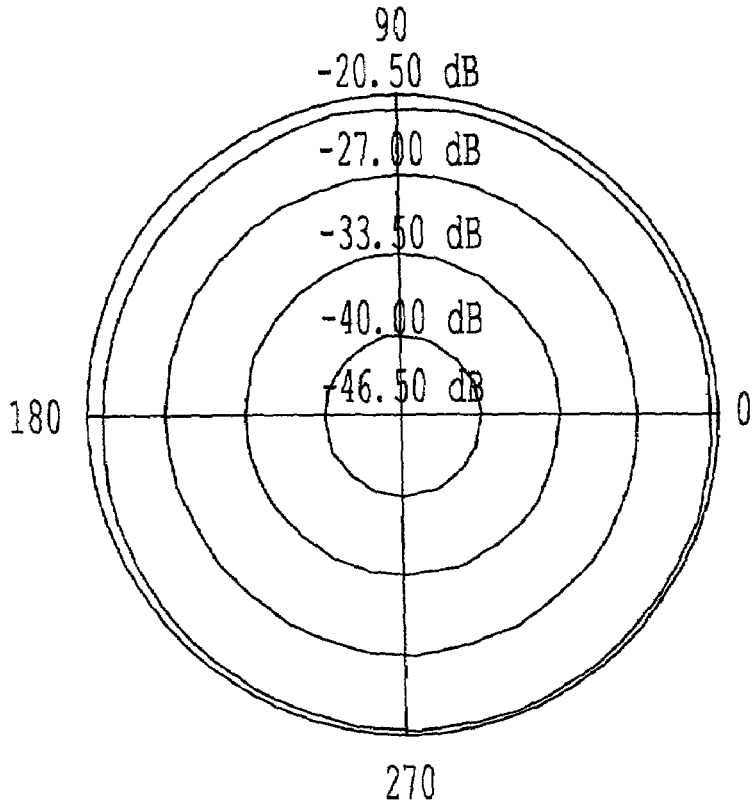
FIG. 12 is a diagram of the H plane of the antenna in FIG. 3 at 960 MHz.

FIGS. 8–12 represent graphical illustrations of results from measurements, which have been performed for an antenna according to FIG. 3. In the measurements, the length of the antenna was 36 mm, and its maximum width was 7 mm. The diagram of FIG. 8 illustrates the standing wave ratio (SWR) curve $S_{11}$ of the antenna and also the transmission curve $S_{12}$. FIGS. 9 and 11 show the E plane diagram of the antenna through the main direction of radiation at the frequencies 880 MHz and 960 MHz, respectively. Correspondingly, FIGS. 10 and 12 illustrate the H plane diagram at the same frequencies. The 0° direction is the normal direction of the rear side of the portable communication apparatus. When comparing these measurements to other measurements performed for commercially available antennas of substantially equal size and of recognized quality, it is observed that the antenna according to the invention will provide an increase in antenna gain of about 1.5–2 dB in for instance the GSM band between 880 and 960 MHz. The reason for this may partly be explained by a reduced coupling to the apparatus housing or chassis of the portable communication apparatus and partly by an improved current distribution along the antenna, which makes better use of the entire aperture of the antenna.

Figure 4:
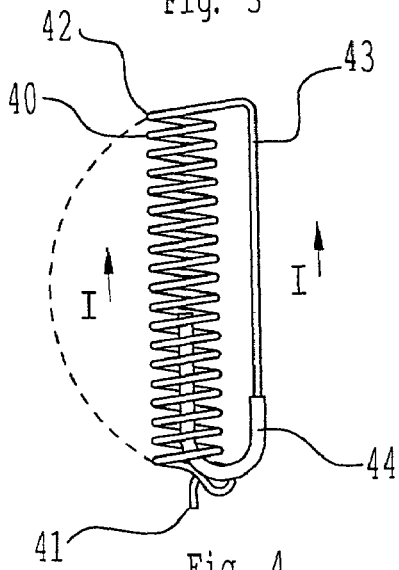
FIG. 4 illustrates a second embodiment of the invention.

A second embodiment of the invention is illustrated in FIG. 4. Reference numeral 40 represents a helical radiator, which corresponds to the helical radiator 30 of FIG. 3 and which has a first end 41 to be connected to radio circuitry within the portable communication apparatus. The helical radiator 40 also has a second end 42, which in similarity with FIG. 3 continues as a linear feedback conductor 43, which is bent downwardly along with the helical radiator 40 towards the first end 41 thereof.

In contrast to FIG. 3, the embodiment of FIG. 4 is not provided with an endcoil at the end of the feedback conductor 43. Instead, this end is bent once again, so that the direction of the last portion 44 of the feedback conductor 43 changes direction by 180° relative to the elongated linear portion of the feedback conductor 43. The bent end 44 of the feedback conductor 43 is isolated and is inserted inside a first portion of the helical radiator 40. Alternatively, as indicated in FIG. 5, the bent isolated end 54 of the feedback conductor 53 may instead be arranged in parallel with the helical radiator 50 outside the helical radiator 50.

Figure 5:
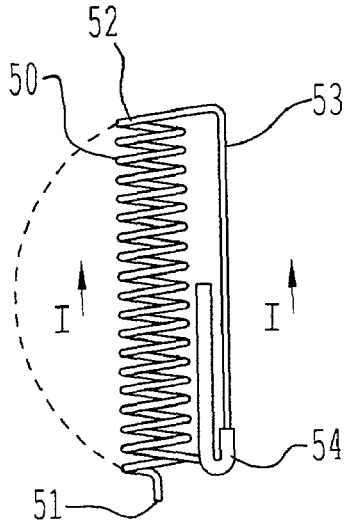
FIG. 5 illustrates a third embodiment of the invention.

The embodiments of FIGS. 4 and 5 provide a distributed feedback load in contrast to the endcoil load 34 of the embodiment shown in FIG. 3. The distributed load allows also a miniaturized antenna to be designed to have considerable broadband properties instead of the discrete multiband properties of the embodiment shown in FIG. 3. If the feedback conductor 43/53 is deeply inserted into the helical radiator 40, or is displaced along a considerable part of the helical radiator 50, the antenna properties are improved at high frequencies, when the resonant frequency ranges of the antenna are shifted towards lower frequencies. The reason for this is that more resonant frequency ranges are added and compressed towards the lowest fixed operating frequency range, as the feedback conductor 43/53 is displaced deeper into or further along the helical radiator 40/50. Thus, there is an expansion of the frequency range, within which the antenna provides good radiation characteristics and matching to e.g. a 50 ohm system.

Figure 20:
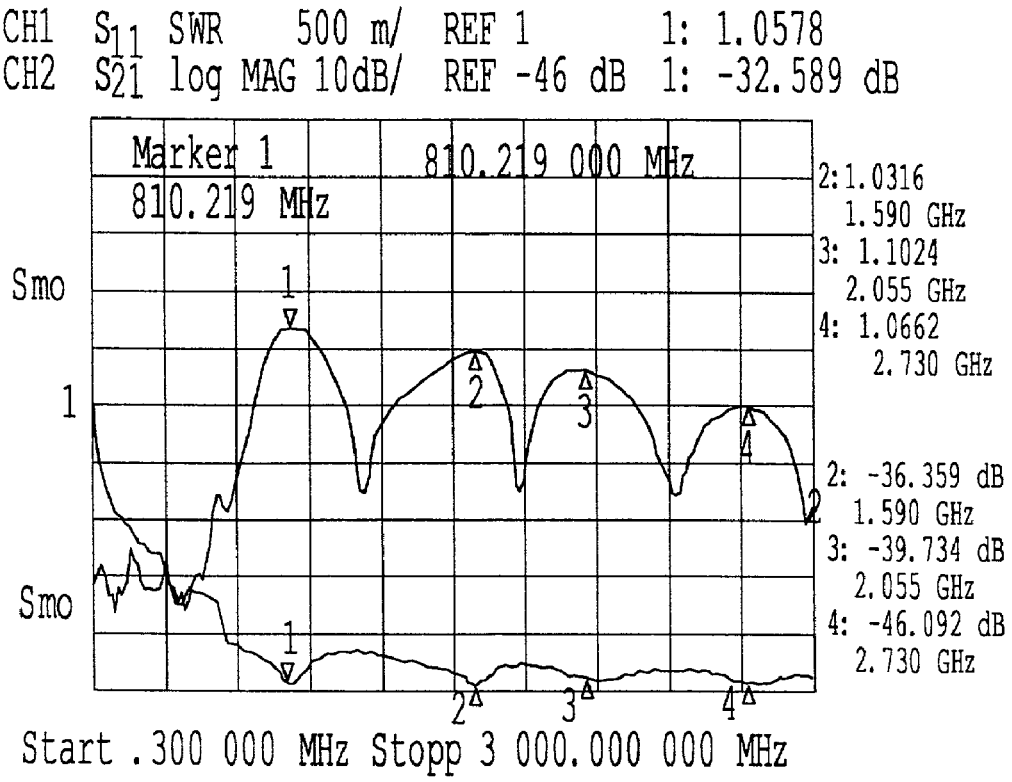
FIG. 20 illustrates the transmission curve $S_{12}$ (in the central portion of the diagram shown in FIG. 20) as well as the standing wave ratio curve (in the lower portion of the diagram) between 0.3 MHz and 3000 MHz for the second embodiment shown in FIG. 4.
Figure 21:
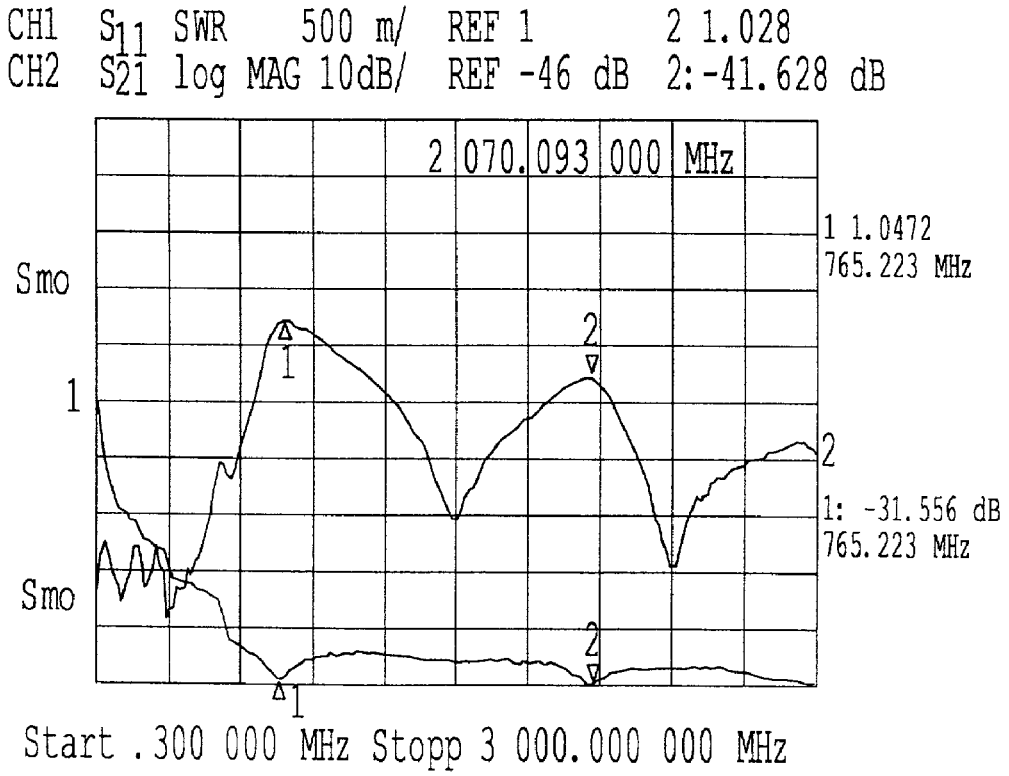
FIG. 21 illustrates a corresponding transmission curve $S_{12}$ and standing wave ratio curve for an antenna like the one shown in FIG. 4, where, however, the feedback conductor has been removed, FIG. 22 corresponds to FIG. 20 but covers a higher frequency range from 3 MHz to 6000 MHz, FIG. 23 corresponds to FIG. 21 but covers the higher frequency range of FIG. 22, i.e. from 3 MHz to 6000 MHz, and FIG. 24 schematically illustrates a portable communication apparatus in the form of a mobile telephone.
Figure 22:
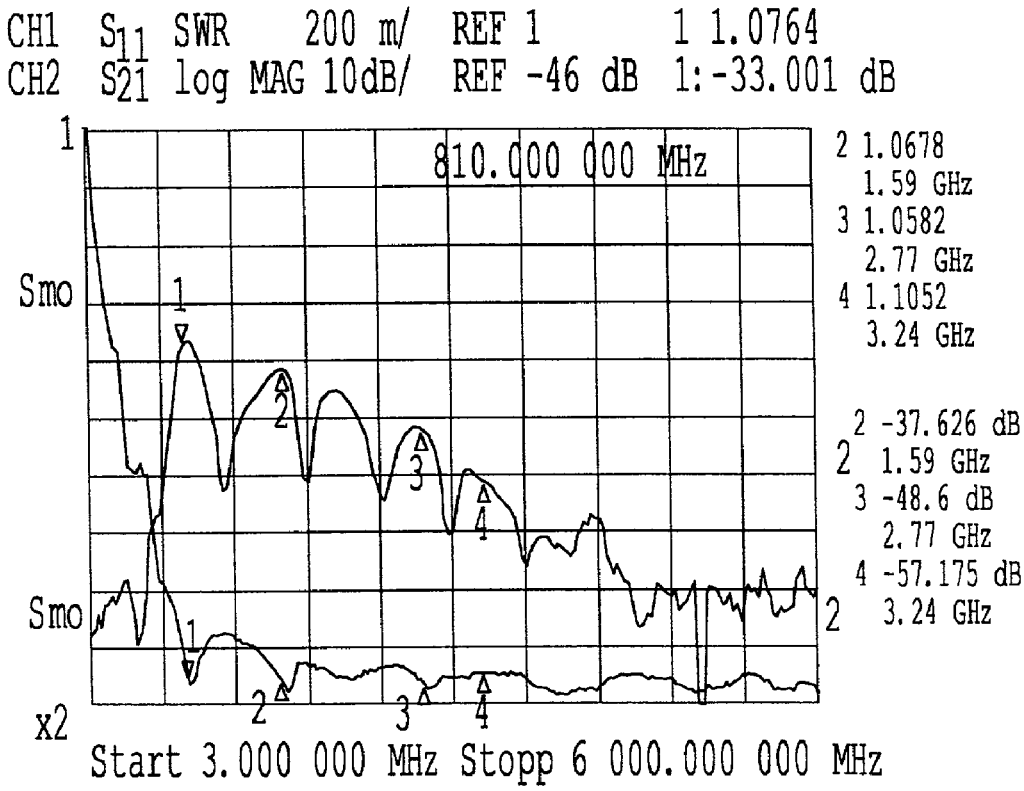
Figure 23:
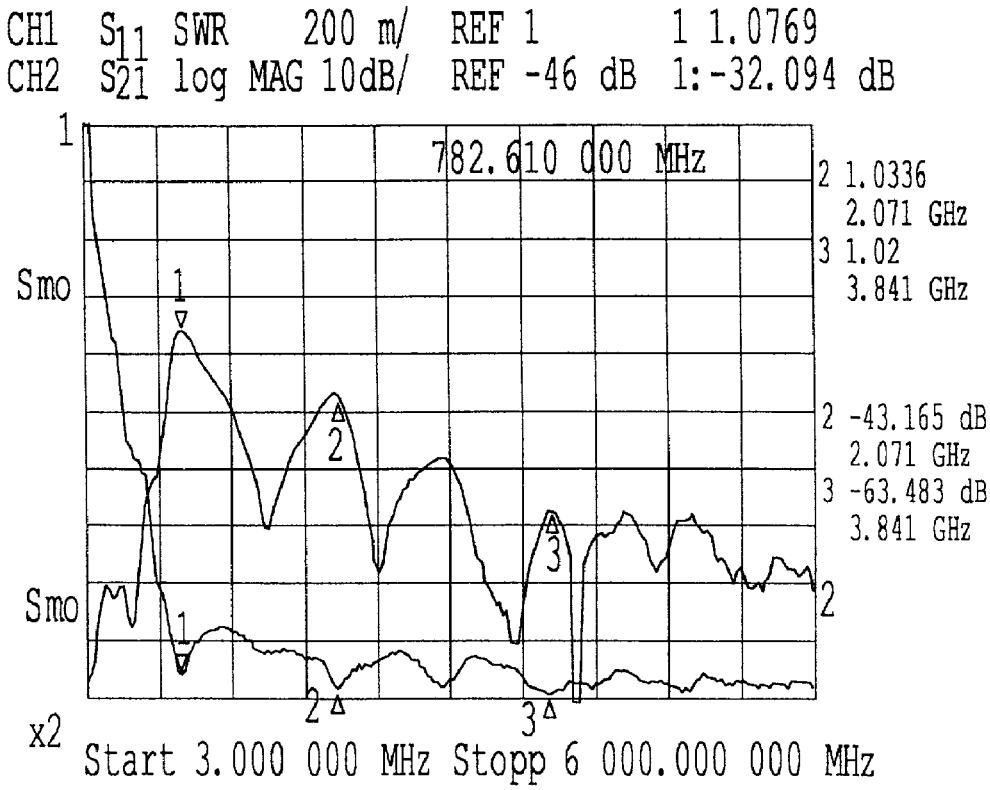
Figure 24:
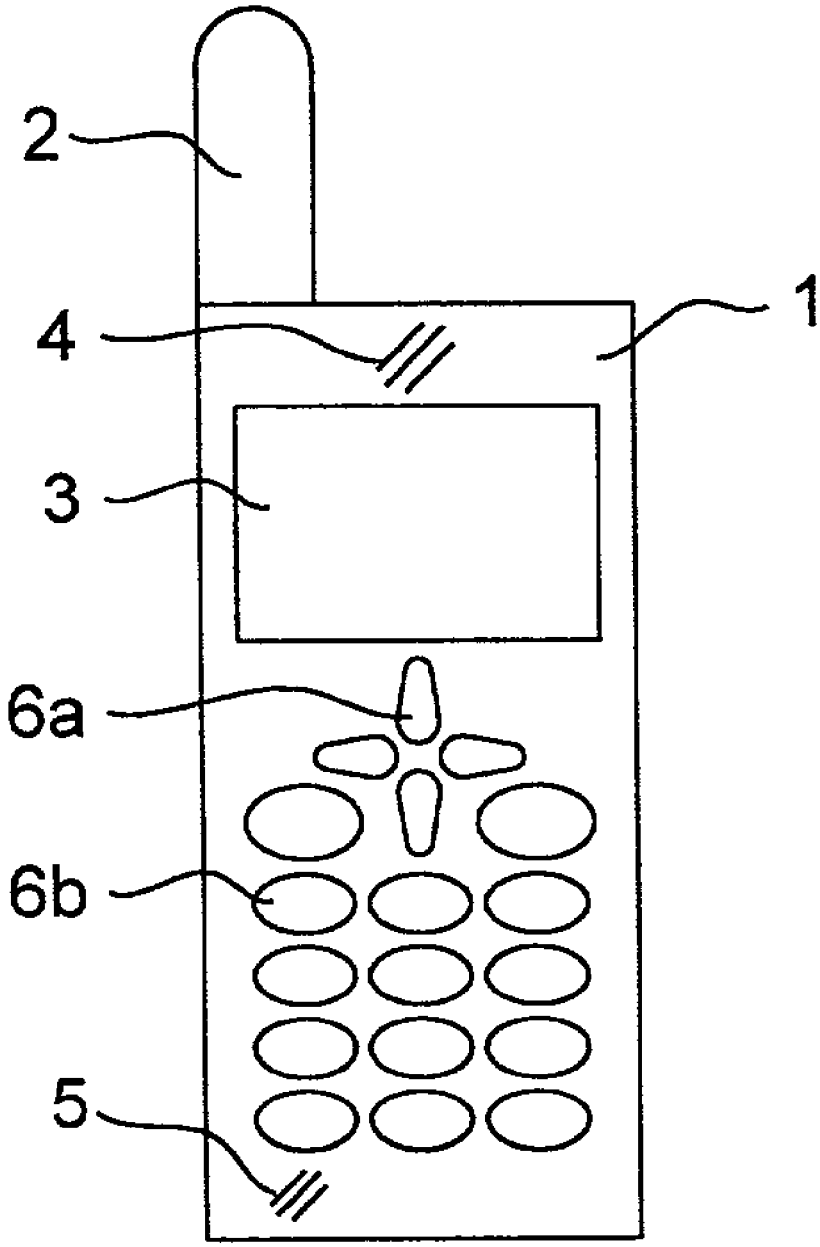

To this end, reference is made to 20–23. FIG. 20 illustrates the transmission curve $S_{12}$ as well as the standing wave ratio (SWR) curve between 0.3 MHz and 3000 MHz for an antenna according to FIG. 4. FIG. 22 is a corresponding diagram but covers a higher frequency range between 3 MHz and 6000 MHz. FIGS. 20 and 22 are to be compared to FIGS. 21 and 23, which represent an antenna like the one in FIG. 4 but without the feedback conductor 43, i.e. with only a helical radiator 40. For FIGS. 20 and 22, the feedback conductor 43 has been inserted into the helical radiator 40 along about 88% of the longitudinal extension of the helical radiator 40.

An antenna as in FIG. 4, with a lowest frequency band at 880–970 MHz, preferably has the following data:

| | |
|---|---|
| Antenna length | 25.5 mm |
| Number of turns in the helical radiator | 20 mm |
| Wire diameter | 0.75 mm |
| Outer diameter (helical radiator) | 3.5 mm |
| Maximum width | 7.0 mm |

Figure 6:
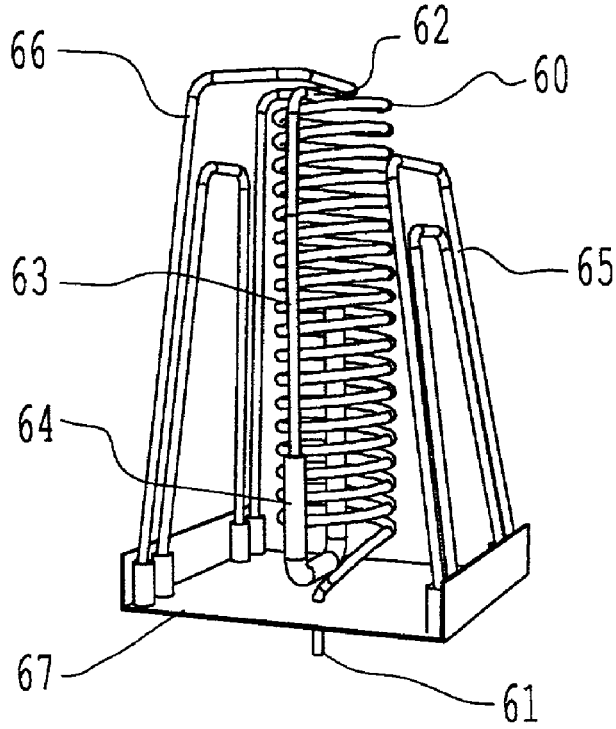
FIG. 6 illustrates a fourth embodiment of the invention.

FIG. 6 illustrates a fourth embodiment of the invention. The embodiment of FIG. 6 is based on the embodiment shown in FIG. 4. In addition, the antenna is provided with a base plate 67, through which the first end 61 of the helical conductor 60 is carried. At opposite edges of the base plate 67, a first satellite radiator 65 and a second satellite radiator 66 are mounted. Reference numerals 60–64 correspond to reference numerals 40–44 of FIG. 4. The purpose of the satellite radiators 65, 66 is to provide an antenna with super broadband capabilities, up to approximately 2 octaves. The satellite radiators assist in filling some narrow dips in the operational range of the helical radiator 63 and the feedback conductor 64.

Figure 13:
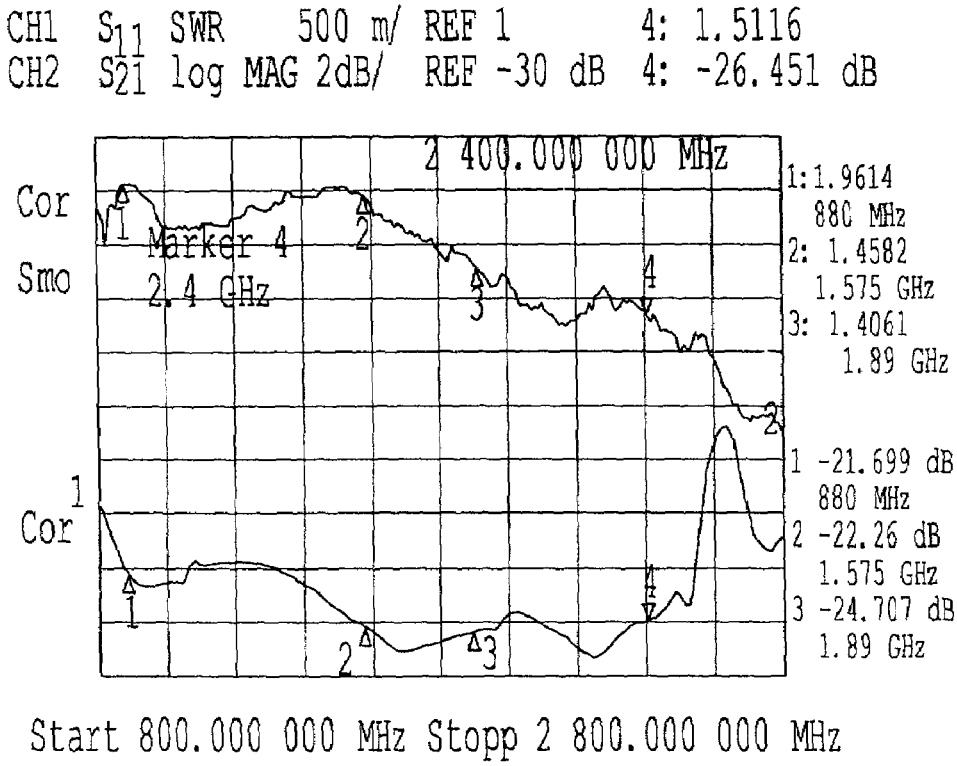
FIG. 13 is a standing wave ratio (SWR) diagram for the fourth embodiment shown in FIG. 6.
Figure 14:
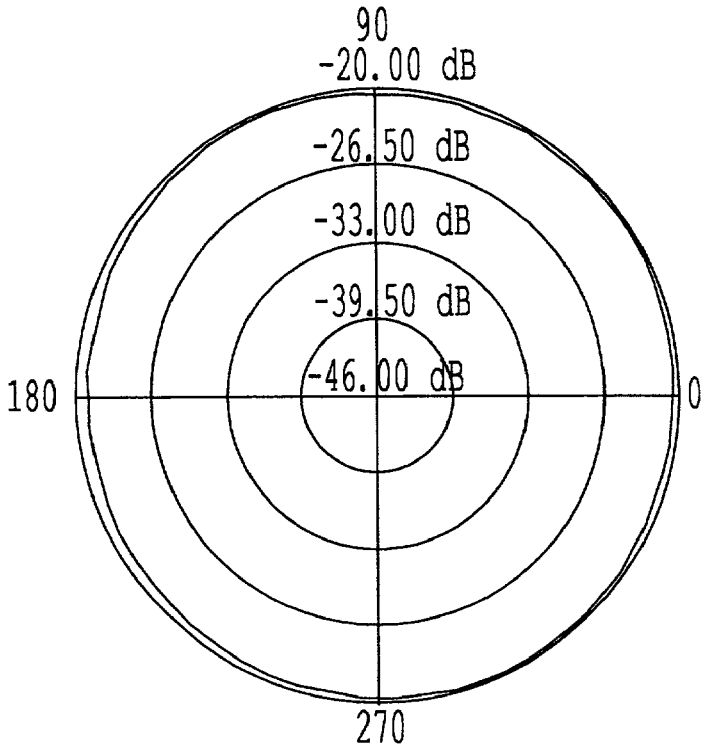
FIG. 14 is a H plane diagram for the antenna shown in FIG. 6 at 880 MHz.
Figure 15:
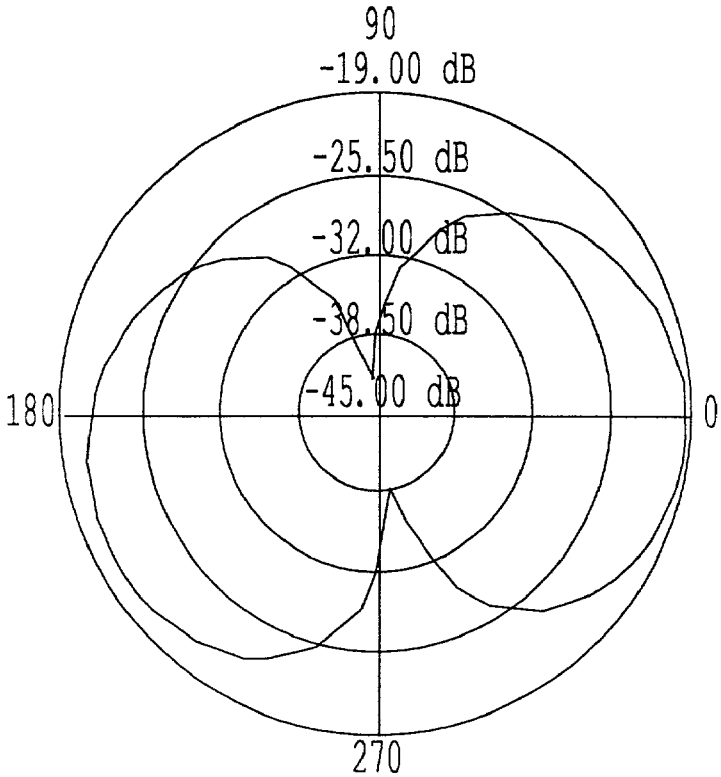
FIG. 15 is an E plane diagram of the antenna shown in FIG. 6 at 880 MHz.
Figure 16:
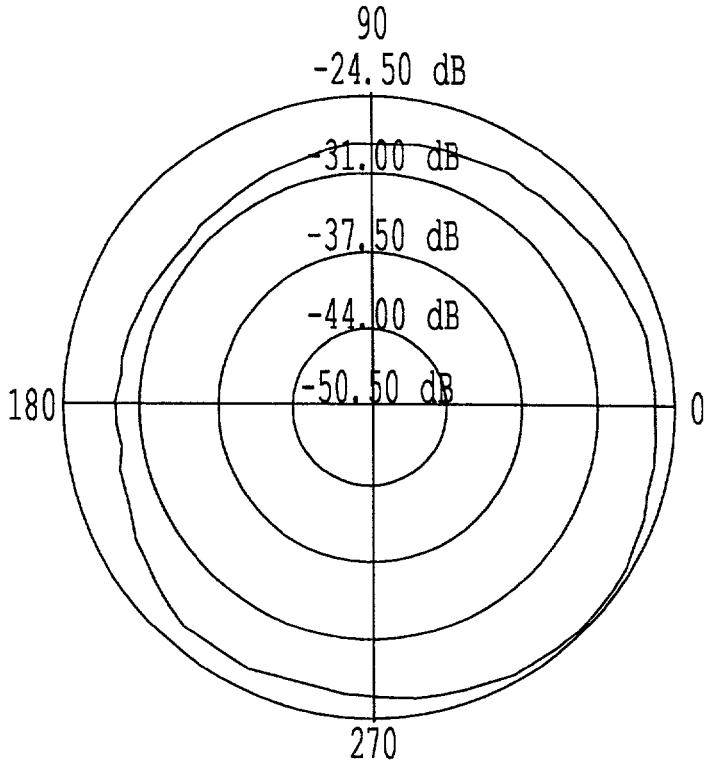
FIG. 16 is a H plane diagram for the antenna shown in FIG. 6 at 2110 MHz.
Figure 17:
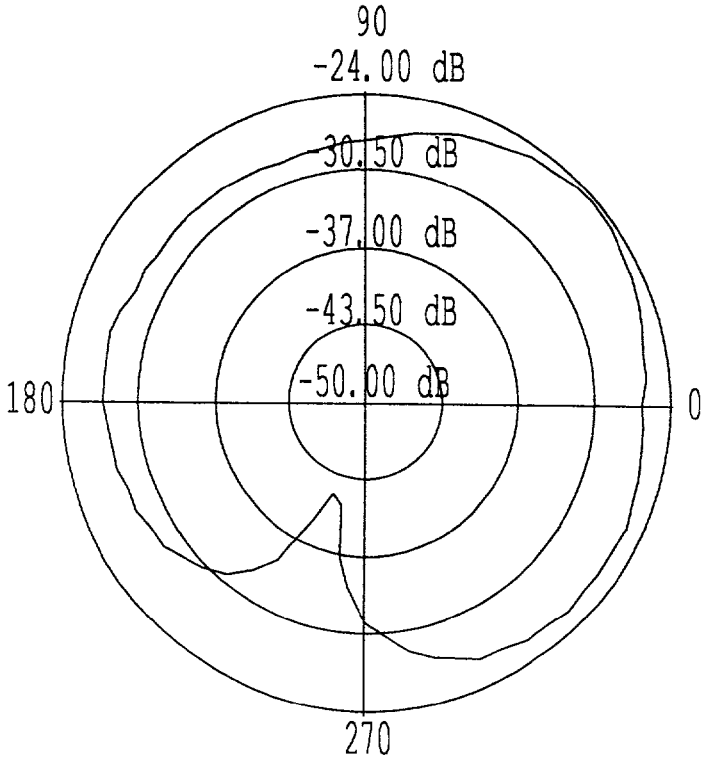
FIG. 17 is an E plane diagram of the antenna shown in FIG. 6 at 2110 MHz.
Figure 18:
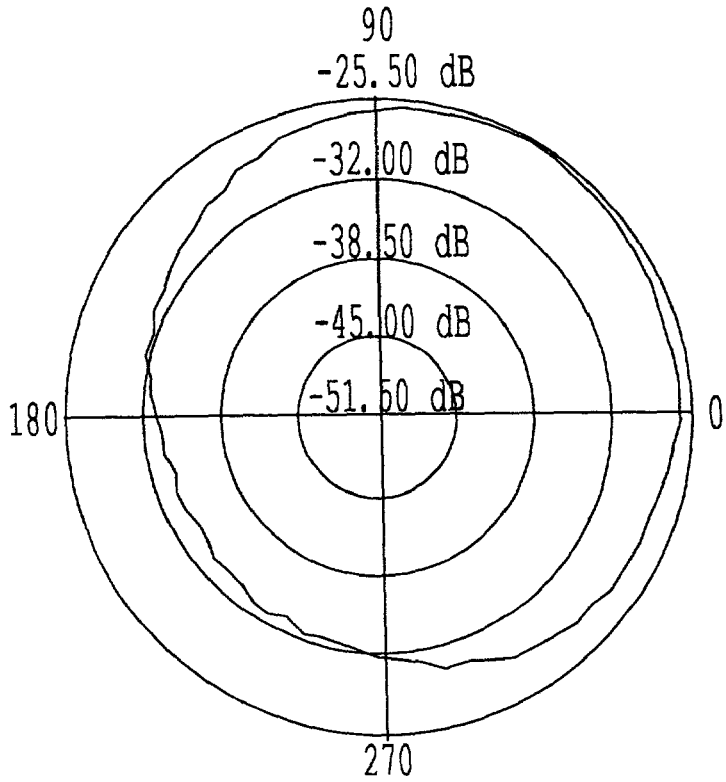
FIG. 18 is a H plane diagram for the antenna shown in FIG. 6 at 2400 MHz.
Figure 19:
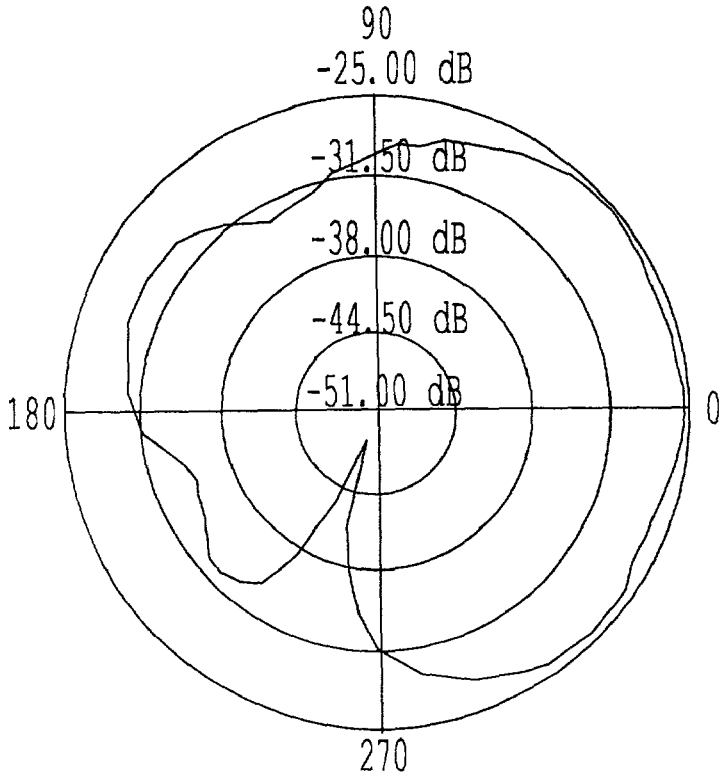
FIG. 19 is an E plane diagram of the antenna shown in FIG. 6 at 2400 MHz.

Measurement data obtained for an antenna according to the embodiment shown in FIG. 6, when mounted to a mobile telephone, are disclosed in FIGS. 13–19. FIG. 13 illustrates the SWR curve $S_{11}$ (at the lower portion of the diagram) as well as the transmission curve $S_{12}$ (at the upper portion of the diagram). FIGS. 14, 16 and 18 illustrate the H plane diagram of the antenna through the main direction of radiation at the frequencies of 880 MHz, 2110 MHz and 2400 MHz, respectively, whereas FIGS. 15, 17 and 19 illustrate corresponding E plane diagrams. In the drawings, 0° is a normal direction from the rear side of the mobile telephone. The table below gives a comparison between the maximum radiation obtained at the three frequencies mentioned above for an antenna according to the invention and corresponding values for an ordinary full-length halv-wave dipole antenna without feedback. It is to be observed that the length of an ordinary halv-wave dipole antenna is about 166 mm at 880 MHz, whereas the length (height) of the inventive feedback antenna is only about 30 mm.

| Frequency (MHz) | Ordinary full-length halv-wave antenna without feedback (dB) | Inventive antenna with feedback (dB) | Difference (dBd)[dBi] |
|---|---|---|---|
| 880 | −18.5 | −20.0 | −1,5 [+0.6] |
| 2110 | −25.5 | −25.0 | +0.5 [+2.6] |
| 2400 | −27.5 | −26.5 | +1.0 [+3.1] |

Preferably, a super broadband antenna according to FIG. 6, having a lowest frequency band at 880–970 MHz, has the following data:

| | |
|---|---|
| Antenna height: | 30.0 mm |
| Number of turns in helical radiator | 23 |

-continued

| | |
|---|---|
| Wire diameter | 0.75 mm |
| Outer diameter of helical radiator | 3.5 mm |
| Maximum width of base plate | 14 mm |
| Maximum depth of base plate | 11 mm |
| Maximum top width | 11 mm |
| Maximum top depth | 10 mm |

Figure 7:
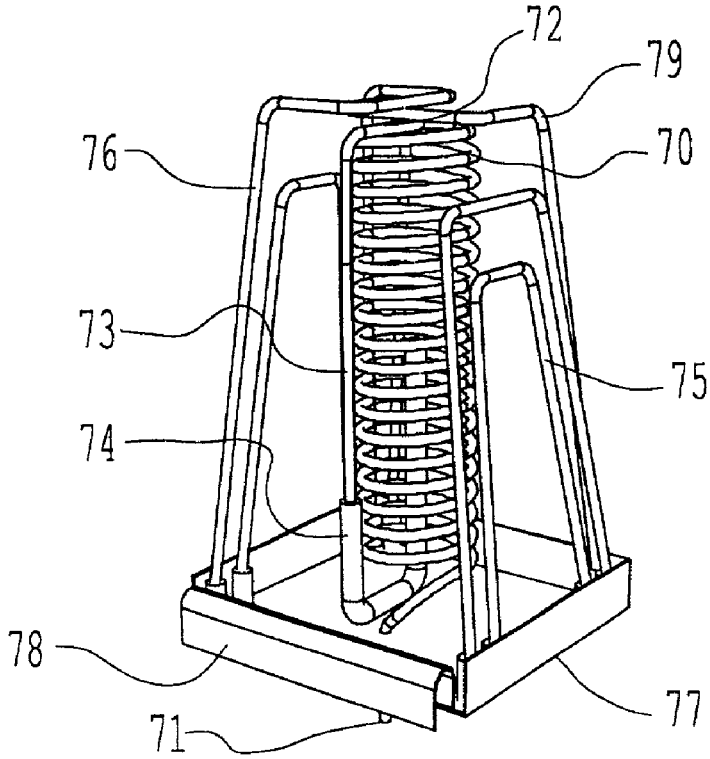
FIG. 7 illustrates a fifth embodiment of the invention.

An improvement of the embodiment shown in FIG. 6 is illustrated in FIG. 7. The embodiment of FIG. 7 is different from the embodiment of FIG. 6 in that a curved structure 78 has been provided along the front edge of the base plate 77 with the purpose of displacing the antenna impedance curve in a Smith diagram to a more central position. Moreover, an additional satellite radiator 79 has been provided at a rear edge of the base plate 77. Reference numerals 70–77 correspond to reference numerals 60–67 of FIG. 6.

All of the embodiments described above may advantageously be embedded in a dielectric material, as is well known per se to a man skilled in the art. Alternatively, any of the embodiments above may be provided with a dielectric radome, which encloses the antenna. Radome-enclosed antennas are thoroughly analyzed in "Analysis of radome-enclosed antennas", by Kozakoff and Schrank, having ISBN number 0890067163.

The antenna embodiments described above may be used for a variety of portable communication apparatuses, such as mobile telephones, cordless telephones, portable digital assistants, communicators and paging devices. It should be apparent to a man skilled in the art, that the exact design, dimensioning, choice in material, etc, must be carefully selected and tuned depending on a practical application and use.

The invention is applicable also to other types of antennas than those which comprise a helical radiator. For instance, a feedback conductor may be added also to a printed-pattern meander-shaped antenna, or to a patch antenna. Specifically, for a printed-pattern meander-shaped antenna, the phase distribution may be controlled by the addition of a feedback conductor according to the invention. Correspondingly, for a patch antenna, a feedback conductor may provide a broader bandwidth of the patch antenna.

Moreover, some embodiments of the invention may be formed as a structure in a multi-layer printed circuit board.

Consequently, even if the invention has been described above with reference to a few embodiments, the invention is equally applicable also to other embodiments not shown herein. The scope of the invention is best defined by the appended independent patent claim.

What is claimed is:

1. An antenna for a portable communication apparatus, the antenna comprising a radiator having a first end to be connected to radio circuitry in the portable communication apparatus, and a second end, a feedback conductor having a first end, which is electrically connected to the second end of the radiator, the feedback conductor extending along the radiator in a first direction from the second end of the radiator towards the first end of the radiator, wherein the feedback conductor includes a second end, extending along the radiator in a second direction towards the second end of the radiator, for tuning a frequency range of the antenna, and said radiator is an elongated helical radiator.

2. The antenna according to claim 1, wherein the second end of the feedback conductor is wound in at least one turn outside the helical radiator near the first end of the helical radiator.

3. The antenna according to claim 1, wherein the second end of the feedback conductor is isolated and bent substantially 180°, wherein at least a portion of said isolated end of the feedback conductor extends inside at least a portion of the helical radiator substantially in parallel with a longitudinal axis of the helical radiator.

4. The antenna according to claim 1, wherein the second end of the feedback conductor is isolated and bent substantially 180°, wherein at least a portion of the isolated end of the feedback conductor extends outside the helical radiator substantially in parallel with a longitudinal axis of the helical radiator.

5. The antenna according to claim 3, further comprising a base plate and at least one satellite radiator mounted on said base plate.

6. The antenna according to claim 5, wherein two satellite radiators are mounted at opposite edges of the base plate and the helical radiator is positioned between the two satellite radiators.

7. The antenna according to claim 5, wherein three satellite radiators are mounted at respective edges of the base plate and the helical radiator is positioned between the three satellite radiators.

8. A multi-layer printed circuit board, comprising an antenna including a radiator having a first end to be connected to radio circuitry in the portable communication apparatus, and a second end, a feedback conductor having a first end, which is electrically connected to the second end of the radiator, the feedback conductor extending along the radiator In a first direction from the second end of the radiator towards the first end of the radiator, wherein the feedback conductor includes a second end, extending along the radiator in a second direction towards the second end of the radiator, for tuning a frequency range of the antenna.

* * * * *